US008943989B2

(12) United States Patent
Paquelet, II

(10) Patent No.: US 8,943,989 B2
(45) Date of Patent: Feb. 3, 2015

(54) ANCHOR HOLDING DEVICE

(71) Applicant: Richard Francis Paquelet, II, Bradenton, FL (US)

(72) Inventor: Richard Francis Paquelet, II, Bradenton, FL (US)

( * ) Notice: Subject to any disclaimer, the term of this patent is extended or adjusted under 35 U.S.C. 154(b) by 139 days.

(21) Appl. No.: 13/706,627

(22) Filed: Dec. 6, 2012

(65) Prior Publication Data

US 2014/0069311 A1 Mar. 13, 2014

Related U.S. Application Data

(60) Provisional application No. 61/699,621, filed on Sep. 11, 2012.

(51) Int. Cl.
*B63B 17/00* (2006.01)
*B63B 21/22* (2006.01)

(52) U.S. Cl.
CPC ..... *B63B 17/00* (2013.01); *B63B 21/22* (2013.01)
USPC ..... 114/210; 114/294

(58) Field of Classification Search
CPC ..... B63B 21/22; B63B 21/16; B63B 21/04; B63B 21/26; B63B 21/29; B63B 17/00; B63B 35/731; B63B 25/002; B63B 17/04; B63B 15/00
USPC ..... 114/210, 294, 343, 364
See application file for complete search history.

(56) References Cited

U.S. PATENT DOCUMENTS

| | | | | |
|---|---|---|---|---|
| 2,705,467 | A * | 4/1955 | Ogg et al. | 114/210 |
| 3,101,067 | A * | 8/1963 | Brydon | 114/210 |
| 4,078,512 | A * | 3/1978 | Rossini | 114/210 |
| 4,164,194 | A * | 8/1979 | Kurz | 114/210 |
| 5,394,818 | A * | 3/1995 | Walker et al. | 114/294 |
| 6,067,924 | A * | 5/2000 | Chatelain | 114/343 |

* cited by examiner

*Primary Examiner* — Lars A Olson

(57) ABSTRACT

A device for securing an anchor. The anchor securing device may comprise a shank holder for securing a shank of the anchor and a base fluke holder for securing the base of the anchor. The shank holder may use an elastic shank rope for further securing the shank to the anchor securing device.

9 Claims, 2 Drawing Sheets

ANCHOR HOLDING DEVICE

BACKGROUND OF THE INVENTION

The present invention relates to an anchor holding device and, more particularly, to an anchor holding device that secures an anchor.

Currently, smaller boats do not have a proper stowage area or stowage device for anchors. One of the more popular anchor designs is the Danforth fluted design anchor. The Danforth anchor has sharp corners, is heavy, made of metal, and does not lay flat on a boat deck. The anchor may be lying on the deck when a boat does not have the proper stowage for the anchor. The anchor may therefore cause safety concerns and boat damage while the ship is at sea.

SUMMARY OF THE INVENTION

Certain anchor holders have a mechanical type closure assembly that needs to be actuated in order to hold the anchor securely. The assemblies may easily become undone, or disengage. This again may cause a safety hazard and damage to the boat.

As can be seen, there is a need for an anchor stowing device that may easily and reliably secure an anchor.

In one aspect of the present invention, an anchor holding device comprises: a support piece comprising a top and a bottom; and an upper piece attached to the support piece near the top of the support piece and a lower piece attached to the support piece near the bottom of the support piece, wherein the lower piece comprises at least one indent configured to secure a fluke of an anchor, wherein the upper piece comprises at least one notch configured to secure a shank of the anchor, wherein the at least one notch comprises a first portion, a second portion, a third portion, a fourth portion and a separation portion, wherein the separation portion is between the first portion and the third portion, wherein the distance between the separation portion and the second portion is less than the distance between the fourth portion and the second portion, whereby when the shaft is in contact with the fourth portion and in between the fourth portion and the second portion, the separation portion is in between the shank of the anchor and the first portion, thereby substantially preventing the shank from passing in between the separation portion and the first portion.

In another aspect of the present invention, a minimum distance between the first portion and the separation portion is at least the width of the shaft.

In another aspect of the present invention, an elastic band is attached to the upper piece and configured to secure the anchor in an engaged position.

In another aspect of the present invention, the elastic band is attached to the third portion and the first portion.

In another aspect of the present invention, a drain is at the bottom of the support piece.

In another aspect of the present invention, the support piece is fastened to a hull of a boat.

In another aspect of the present invention, the support piece is fastened to the hull of the boat by at least one of screws, bolts, and adhesives.

In another aspect of the present invention, the support piece comprises part of a hull of a boat.

In another aspect of the present invention, a boat system comprises: a boat comprising a hull; and the anchor holding device as claimed in claim 1, wherein the hull comprises the support piece.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Broadly, an embodiment of the present invention provides a device for securing an anchor. The anchor securing device may comprise a shank holder for securing a shank of the anchor and a base fluke holder for securing the base of the anchor. The shank holder may use an elastic band for further securing the shank of the anchor.

The present invention may provide a device for proper securing and stowage of an anchor and thereby keeping the anchor off the deck floor of a ship. The device may be an anchor storage device. In certain embodiments, the anchor storage device may securely hold an anchor, such as a Danforth anchor, in an upright position. The device may secure the anchor to the hull of the boat and thereby prevent the anchor from moving while the ship is at sea. In certain embodiments, the anchor storage device may utilize an elastic tension band that provides positive closure, and may substantially increase the reliability that the anchor may be secured in place. The present invention may be easy to use and reliable.

Figure 1:
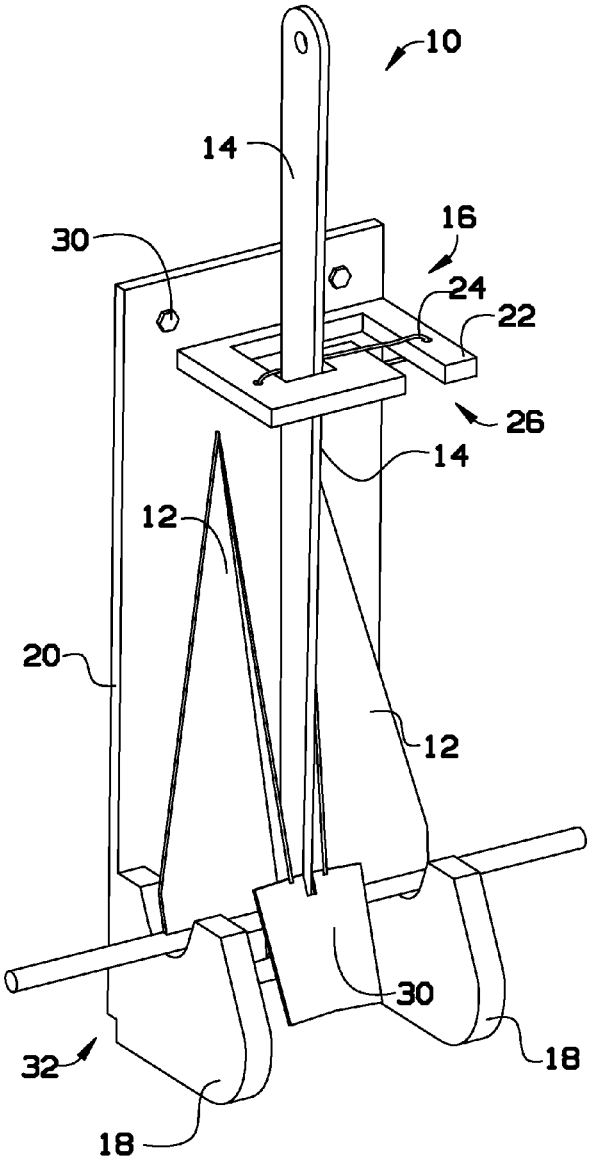
FIG. 1 is an upper perspective view of the invention shown in use.
Figure 2:
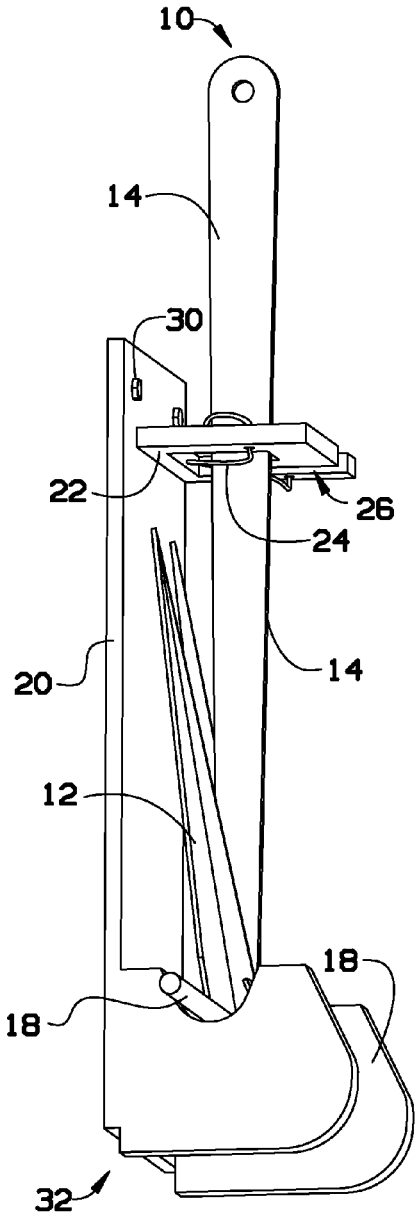
FIG. 2 is a lower side perspective view of the invention shown in use illustrating relative placement of components.
Figure 3:
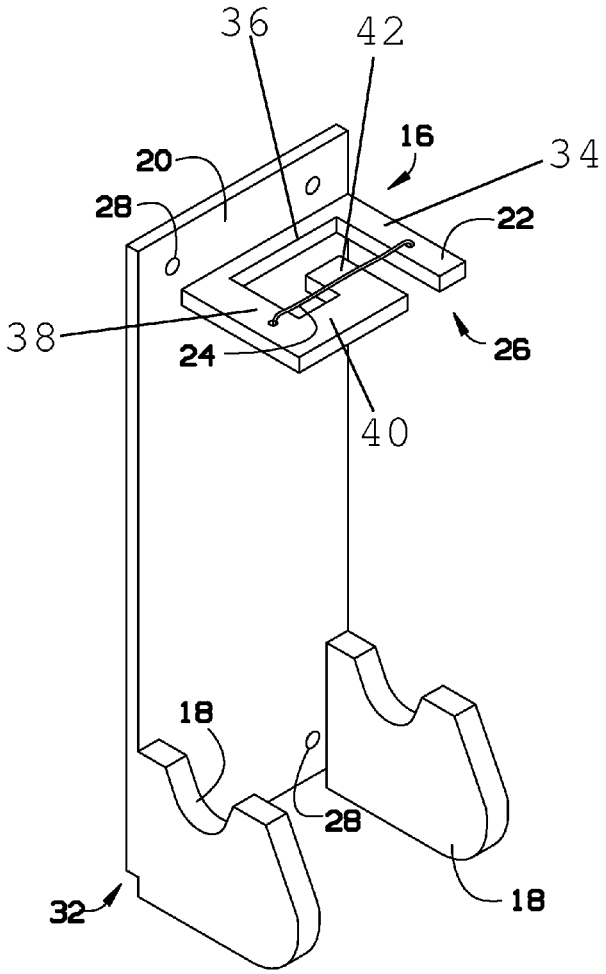
FIG. 3 is a perspective view of the invention.
Figure 4:
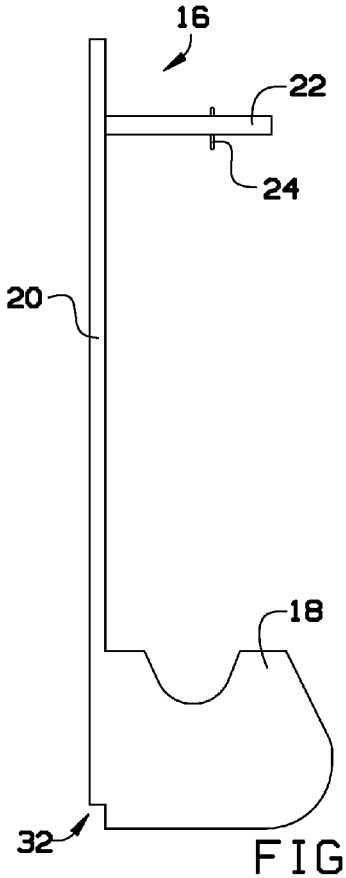
FIG. 4 is a side view of the invention.

Referring now to FIGS. 1 through 4, the device may include an anchor holder 16. The anchor holder 16 may be configured to fit and secure an anchor 10, such as a Danforth anchor. The anchor 10 may be stowed on the anchor holder 16, preventing the anchor 10 from moving on a boat hull. In certain embodiments, the anchor holder 16 may comprise a support piece, an upper piece, and a lower piece. In certain embodiments, the anchor holder 16 may be made of high-density polyethylene (HDPE), such as Marine StarBoard®. However, it is envisioned that the anchor holder 16 may be made of any suitable material.

In certain embodiments, the support piece may be a mounting board 20. The mounting board 20 may be one piece. The lower piece may be connected near the bottom of the mounting board 20 and the upper piece may be connected near the top of the mounting board 20. In certain embodiments, the mounting board 20 may be lengthened, shortened, or cut at certain angles to improve the mounting characteristics. For example, the shape and size of the mounting board 20 may be reconfigured to fit and support different sized anchors. In certain embodiments, the mounting board 20 may be the boat hull and therefore, the upper piece and the lower piece may be directly connected to the hull of the boat.

In certain embodiments, mounting board 20 may include a draining area 32. The draining area 32 may be an opening or a raised area at the bottom of the mounting board 20. The draining area 32 may drain water, sand, or anchor debris onto the boat deck or off of the boat deck. The mounting board 20 may further include through holes 28 near the top and the bottom. The holes 28 may be pre-drilled or drilled at the time of installation into the boat hull. The holes 28 may fit fasteners. For example, the fasteners 30 may include self-tapping screws, bolts, and the like. The fasteners 30 may be used to drill and secure the mounting board to the boat, such as the hull of the boat.

In certain embodiments, the upper piece may be a shank holder 22. The shank holder 22 may be configured to receive and secure the shank 14 of the anchor 10. In certain embodiments, the shank holder 22 may comprise a notch configuration. The notch configuration may include a first portion 34, a second portion 36, a third portion 38, a fourth portion 40, and a separation portion 42. The separation portion 42 may be between the first portion 34 and the third portion 38. The distance between the separation portion and the second portion may be less than the distance between the fourth portion and the second portion. In certain embodiments, when the shaft 14 is in contact with the fourth portion 40 and in between the fourth portion 40 and the second portion 36, the separation portion 42 may be in between the shank 14 of the anchor 10 and the first portion 34, thereby substantially preventing the shank 14 from passing in between the separation portion 42 and the first portion 32.

In certain embodiments, the notch configuration may include an elastic band 23, as illustrated in FIGS. 1 through 4. The elastic band 23 may be attached to the shank holder 22. In certain embodiments, the elastic band 23 may be attached to the shank holder 22 via through holes on the first portion 34 and the third portion 38. The elastic band 24 may further be secured to the shank holder 22 by a copper plate compression fitting after being slotted through the through holes. The elastic band 24 may be about eight inches in length and $3/16^{th}$ of an inch in diameter. In certain embodiments the elastic band 24 may include a nylon covering. The shank holder 22 may be one piece and may be adjusted up or down on the mounting board 20, depending on the preference and size of the anchor 14.

In certain embodiments, the bottom piece may comprise a base fluke holder 18. The base fluke holder 18 may be configured to receive anchor flukes. As illustrated in FIGS. 1 through 4, the base fluke holder 18 may comprise a plurality of pieces. The base fluke holder 18 may further include at least one indent. For example, the indents may be curved indents, rounded indents, squared indents and the like. The flukes 12 of the anchor may fit securely within the indents.

The anchor holder 16 may further include additional supports. The additional supports may further secure the base fluke holder 18 and the shank holder 22. The additional supports may further be utilized to strengthen the bond between the base fluke holder 18 and the shank holder 22 to the mounting board 20.

A method of making the device may include securing the components together by stainless steel screws and other adhesives. The adhesives and screws may add bonding strength to produce a stronger anchor holder. The method of using the device may include the following. A user may secure the anchor by placing the flukes into the indents of the base fluke holder. Then the user may position the shank into the shank holder by pushing the shank into the notch and against the elastic rope. The user may push the shank back and then to the left to allow the shank to rest in the notch of the shank holder. The anchor is thereby secured within the anchor holder.

It should be understood, of course, that the foregoing relates to exemplary embodiments of the invention and that modifications may be made without departing from the spirit and scope of the invention as set forth in the following claims.

What is claimed is:

1. An anchor holding device comprising:

a support piece comprising a top and a bottom; and an upper piece attached to the support piece near the top of the support piece and a lower piece attached to the support piece near the bottom of the support piece, wherein the lower piece comprises at least one indent configured to secure a fluke of an anchor, wherein the upper piece comprises at least one notch configured to secure a shank of the anchor, wherein the at least one notch comprises a first portion, a second portion, a third portion, a fourth portion and a separation portion, wherein the separation portion is between the first portion and the third portion, wherein the distance between the separation portion and the second portion is less than the distance between the fourth portion and the second portion, whereby when the shank is in contact with the fourth portion and in between the fourth portion and the second portion, the separation portion is in between the shank of the anchor and the first portion, thereby substantially preventing the shank from passing in between the separation portion and the first portion.

2. The anchor holding device of claim 1, wherein a minimum distance between the first portion and the separation portion is at least the width of the shank.

3. The anchor holding device of claim 1, further comprising an elastic band attached to the upper piece and configured to secure the anchor in an engaged position.

4. The anchor holding device of claim 3, wherein the elastic band is attached to the third portion and the first portion.

5. The anchor holding device of claim 1, further comprising a drain at the bottom of the support piece.

6. The anchor holding device of claim 1, wherein the support piece is fastened to a hull of a boat.

7. The anchor holding device of claim 6, wherein the support piece is fastened to the hull of the boat by at least one of screws, bolts, and adhesives.

8. The anchor holding device of claim 1, wherein the support piece comprises part of a hull of a boat.

9. A boat system comprising:

a boat comprising a hull; and the anchor holding device as claimed in claim 1, wherein the hull comprises the support piece.

* * * * *